US008869878B2

(12) United States Patent
Yang

(10) Patent No.: US 8,869,878 B2
(45) Date of Patent: Oct. 28, 2014

(54) FLAT PLATE HEAT PIPE AND METHOD FOR MANUFACTURING THE SAME

(75) Inventor: Hsiu-Wei Yang, Sinjhuang (TW)

(73) Assignee: Asia Vital Components Co., Ltd., Sinjhuang, Taipei (TW)

( * ) Notice: Subject to any disclaimer, the term of this patent is extended or adjusted under 35 U.S.C. 154(b) by 471 days.

(21) Appl. No.: 12/824,250

(22) Filed: Jun. 28, 2010

(65) Prior Publication Data

US 2011/0259554 A1 Oct. 27, 2011

(51) Int. Cl.

| | |
|---|---|
| ***F28D 15/00*** | (2006.01) |
| ***F28F 7/00*** | (2006.01) |
| ***F28D 15/02*** | (2006.01) |
| ***B21D 53/02*** | (2006.01) |
| ***F28D 15/04*** | (2006.01) |

(52) U.S. Cl.

CPC ..... *F28D 15/04* (2013.01); *F28D 15/0233* (2013.01); *B21D 53/02* (2013.01); *F28D 15/046* (2013.01)

USPC ..... 165/104.26; 165/104.11; 165/104.19; 165/104.21; 165/104.23; 165/104.33; 165/80.2

(58) Field of Classification Search

CPC ... F28D 15/0266; F28D 15/023; F28D 15/00; F28D 20/00; F28D 15/046; F25B 21/00; H01L 23/3672; F28F 3/02

USPC ..... 165/104.23, 104.21, 104.19, 104.11, 165/185, 104.33, 104.26

See application file for complete search history.

(56) References Cited

U.S. PATENT DOCUMENTS

| | | | | |
|---|---|---|---|---|
| 6,533,029 | B1 * | 3/2003 | Phillips | 165/104.26 |
| 6,997,245 | B2 * | 2/2006 | Lindemuth et al. | 165/104.26 |
| 7,942,196 | B2 * | 5/2011 | Lai et al. | 165/104.26 |
| 2002/0179288 | A1 * | 12/2002 | Ishida et al. | 165/104.26 |
| 2003/0159806 | A1 * | 8/2003 | Sehmbey et al. | 165/80.3 |
| 2006/0060330 | A1 * | 3/2006 | Siu | 165/104.26 |
| 2007/0294892 | A1 * | 12/2007 | Yang et al. | 29/890.032 |
| 2007/0295486 | A1 * | 12/2007 | Su et al. | 165/104.26 |
| 2009/0025910 | A1 * | 1/2009 | Hoffman et al. | 165/104.26 |
| 2009/0040726 | A1 * | 2/2009 | Hoffman et al. | 361/700 |
| 2009/0101314 | A1 * | 4/2009 | Lindner | 165/104.26 |

* cited by examiner

*Primary Examiner* — Brandon M Rosati
*Assistant Examiner* — Claire Rojohn, III
(74) *Attorney, Agent, or Firm* — C. G. Mersereau; Nikolai & Mersereau, P.A.

(57) ABSTRACT

The present invention relates to a flat plate heat pipe and a method for manufacturing the same. The heat pipe includes a flattened pipe whose inner surface is coated with a wick structure layer. The interior of the flattened pipe is provided with a sintered supporting layer and a working fluid. The sintered supporting layer has a plurality of posts arranged in the flattened pipe to vertically support therein. With this arrangement, the thickness of the pipe can be reduced but the whole structural strength can be maintained to prevent deformation. Further, a return path for the working fluid can be provided in the pipe. By only sealing two sides of the pipe, a sealed chamber can be formed for the operation of the working fluid. By the inventive method, the manufacturing process can be simplified and a larger space inside the chamber can be obtained.

7 Claims, 9 Drawing Sheets

FLAT PLATE HEAT PIPE AND METHOD FOR MANUFACTURING THE SAME

This application claims the priority benefit of Taiwan patent application number 099113103 filed on Apr. 26, 2010.

BACKGROUND OF THE INVENTION

1. Field of the Invention

The present invention relates to a flat plate heat pipe and a method for manufacturing the same, and in particular to a flat plate heat pipe in which a sintered supporting layer is provided and a method for manufacturing the same.

2. Description of Prior Art

With the advancement of science and technology, the amount of heat generated by an electronic component during its operation is increased greatly. Thus, it is an important issue for the electronic industry to solve the problems relating to the cooling or heat dissipation of the electronic components. Further, in view of the requirements for high efficiency, integration and versatility of the electronic components, the manufacturers in the electronic industry aims to increase the heat transfer efficiency.

A heat sink is often used to dissipate the heat of an element or system to the outside. In case of a smaller thermal resistance, the heat-dissipating efficiency of the heat sink becomes larger. In general, the thermal resistance of the heat sink is constituted of a spreading resistance within the heat sink and a convection resistance between the surface of the heat sink and ambient atmosphere. In practical applications, materials of high thermal conductivity such as copper or aluminum are used to manufacture the heat sink to thereby reduce the spreading resistance. However, the convection resistance is still so large that it undesirably restricts the performance of the heat sink. As a result, the heat-dissipating efficiency of the heat sink cannot conform to requirements for the heat dissipation of new-generation electronic elements.

As mentioned in the above, in order to enhance the heat-dissipating efficiency, various kinds of heat pipes and vapor chambers with high thermal conductivity are developed to be assembled with a heat sink.

The heat-dissipating principle of the vapor chamber is substantially the same as that of the heat pipe. A working fluid is filled in the vapor chamber having an evaporating surface and a condensing surface opposite to the evaporating surface. The evaporating surface is brought into contact with a heat source to absorb the heat of the heat source, thereby heating and evaporating the working fluid in the vapor chamber. When the vapor is brought into contact with a cold surface (i.e., the condensing surface), the vapor condenses into liquid to release the latent heat. With the phase change between vapor and liquid of the working fluid, the heat of the heat source can be conducted to the condensing surface.

Please refer to FIG. 1. The conventional flat plate heat pipe is constituted of a first copper plate 10 and a second copper plate 11. The first copper plate 10 is connected to the second copper plate 11 to define a chamber 12 there between. The chamber 12 is filled with a working fluid such as water or other suitable liquid. Two opposing surfaces of the first copper plate 10 and the second copper plate 11 are formed with a wick structure 13 respectively in such a manner that the inner surfaces of the chamber 12 are coated with the wick structure 13. Conventionally, the primary functions of the wick structure 13 are as follows: the amount of heat passing through the wall of the vapor chamber is reduced; the total area for evaporating the working fluid is increased; and the growth of vapor film is prevented due to the contact of the wick structure and the wall of the chamber. Due to gravity and capillary force of the working fluid, the working fluid is distributed in the wick structure 13 inside the chamber 12 (i.e. the wick structure 13 provided on the first copper plate 10 and the second copper plate 13).

The outer surface of the first copper plate 10 opposite to the chamber 12 is brought into contact with a heat-generating element (such as a central processor). At this time, the first copper plate 10 is referred to as an evaporating end, whereby the heat generated by the heat-generating element is conducted to the second copper plate 11 (referred to as a condensing end) for heat dissipation. Thus, the heat generated by the heat-generating element is absorbed by the first copper plate 10, thereby heating and evaporating the working fluid on the wick structure 13.

Thereafter, the vapor quickly flows toward a colder place (i.e. the second copper plate 11) where the vapor releases its latent heat and condenses into liquid. By means of the capillary force of the wick structure 13 on the second copper plate 11, the condensed droplets of the working fluid flow back to the first copper plate 10. With this circulation of the working fluid, the heat of the heat-generating element can be dissipated.

However, during the phase change of the working fluid between vapor and liquid, the working fluid flowing in the wick structure 13 may cause some problems as follows. (1) Although the increase of the heat flux also raises the phase-changing speed of the working fluid, the amount of working fluid flowing back to the evaporating end is insufficient because the tiny pores and low permeability of the wick structure may hinder the working fluid from flowing back to the evaporating end. As a result, the evaporating end of the heat pipe may be dried out to deteriorate its heat-dissipating efficiency. (2) When the heat flux continuously increases to such an extent that the vapor pressure is larger than the liquid pressure, vapors or bubbles may be generated in the wick structure to hinder the working fluid from flowing back to the evaporating end. Then, a film of vapor having a large thermal resistance is generated between the evaporating end and the wick structure, so that the heat absorbed by the evaporating end cannot be taken away by the working fluid smoothly. As a result, the heat is continuously accumulated in the evaporating end, so that the evaporating end of the heap pipe is dried out to deteriorate its heat-dissipating efficiency.

According to the above, the conventional flat plate heat pipe has drawbacks as follows;

(1) Since the casing of the heat pipe is constituted of an upper plate and a lower plate, four sides of the upper plate and the lower plate are soldered to form a sealed casing. Thus, the actual working space available for accommodating the working fluid will be inevitably reduced due to the soldered sides of the upper plate and the lower plate.

(2) Since four sides of the upper plate and the lower plate have to be soldered together to form a sealed casing, the process is no doubt time-consuming with a higher production cost.

Therefore, the present inventor and the manufacturers in this filed to solve the above-mentioned problems in prior art.

SUMMARY OF THE INVENTION

In order to solve the above problems, an objective of the present invention is to provide a flat plate heat pipe, in which a sintered supporting layer is supported between an upper plate and a lower plate thereof to thereby avoid the deformation of the flat plate heat pipe and maintain a sufficient structural strength. Since the sintered supporting layer has a number of apertures, vapors of a working fluid can diffuse to fill up the inner space of the flat plate heat pipe. Further, condensed droplets of the working fluid in the heat pipe can flow through the sintered supporting layer in both transverse and longitudinal directions to increase the return path of the working fluid.

Another objective of the present invention is to provide an improved method for manufacturing a flat plate heat pipe, whereby a pipe is pressed into a flattened pipe. In comparison with the combination of an upper plate and a lower plate in prior art, the wall thickness of the flatted pipe can be made thinner to form a more compact heat pipe. Since only two sides of the flattened pipe are to be soldered to form a sealed chamber, a larger space within the heat pipe can be obtained for the operation of the working fluid than that obtained by soldering four sides of a conventional vapor chamber.

In order to achieve the above objectives, the present invention provides a flat plate heat pipe, which includes:

a flattened pipe having a continuously surrounding wall unit, the wall unit defining a chamber for receiving a working fluid, a first sealing side and a second sealing side being provided on both sides of the wall unit for sealing the chamber, the wall unit having an upper plate and a lower plate facing the upper plate;

a sintered supporting layer having a plurality of posts arranged in the chamber to vertically support between the upper plate and the lower plate, the posts having an upper side facing the upper plate and a lower side facing the lower plate; and a wick structure layer coated on one surface of the wall unit facing the chamber.

In order to achieve the above objectives, the present invention further provides a method for manufacturing a flat plate heat pipe, including steps of:

providing a pipe having a continuously surrounding wall unit, the wall unit defining a chamber therein, the chamber being formed with a first through-hole and a second through-hole on both sides of the pipe;

pressing the pipe for the first time to become a flattened pipe, the flattened pipe having an upper plate and a lower plate;

preparing a sintered supporting layer having a plurality of posts, disposing the sintered supporting layer in the chamber to make the upper side of the posts to face the lower portion and the lower side thereof to face the lower plate;

pressing the flattened pipe for the second time to narrow a gap between the upper plate and the lower plate, thereby making the upper plate and the lower plate to abut against the upper side and the lower side of the posts respectively;

providing a conduit having a first end exposed to the pipe and a second end in communication with the chamber;

sealing the first through-hole and the second through-hole of the flattened pipe to form a first sealing side and a second sealing side to thereby seal the chamber, the upper side and the lower side of the posts being connected to the upper plate and the lower plate respectively;

connecting the conduit to the flattened pipe;

evacuating air in the chamber through the conduit, and filling a working fluid in the chamber through the conduit, and sealing the first end of the conduit.

In order to further understand the characteristics and technical contents of the present invention, the detailed description relating thereto will be explained with reference to accompanying drawings.

DETAILED DESCRIPTION OF THE INVENTION

The present invention provides a flat plate heat pipe and a method for manufacturing the same. The drawings show a preferred embodiment of the present invention. Please refer to FIGS. 2, 3A and 3B, which show the flat plate heat pipe of the present invention including a pipe 21, a sintered supporting layer 22 and a wick structure 23.

Figure 1:
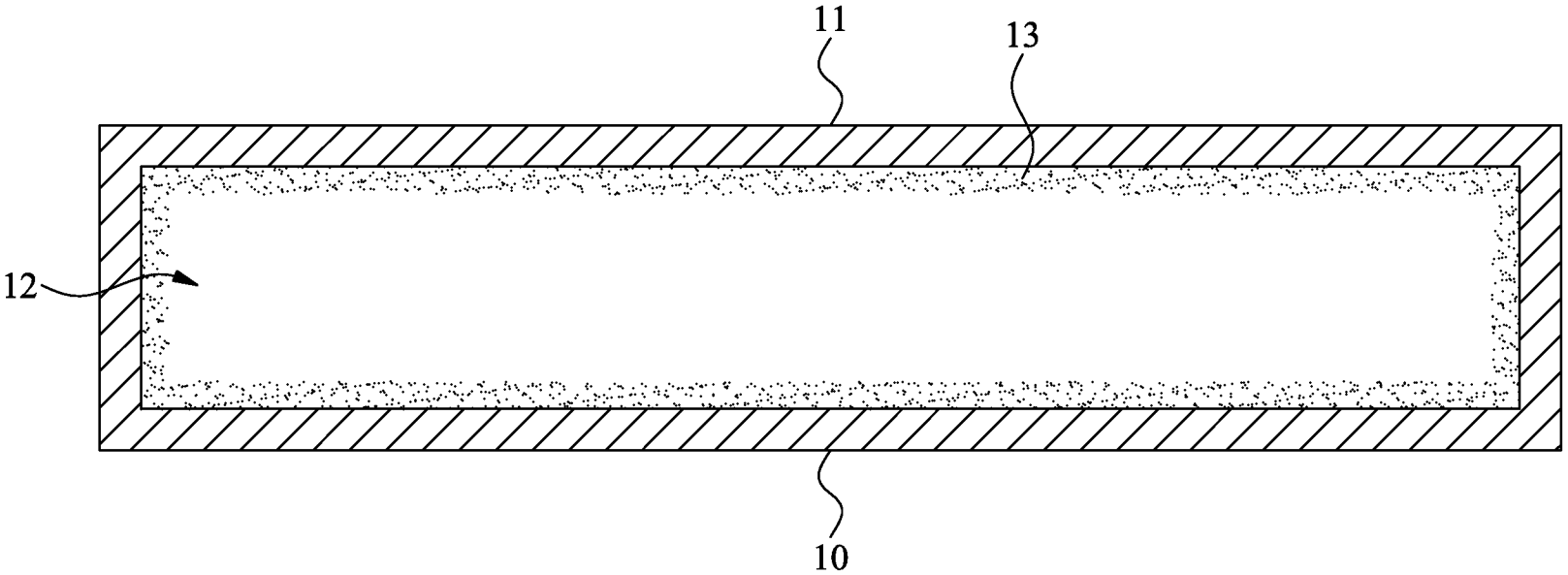
FIG. 1 is a schematic view of prior art.
Figure 2:
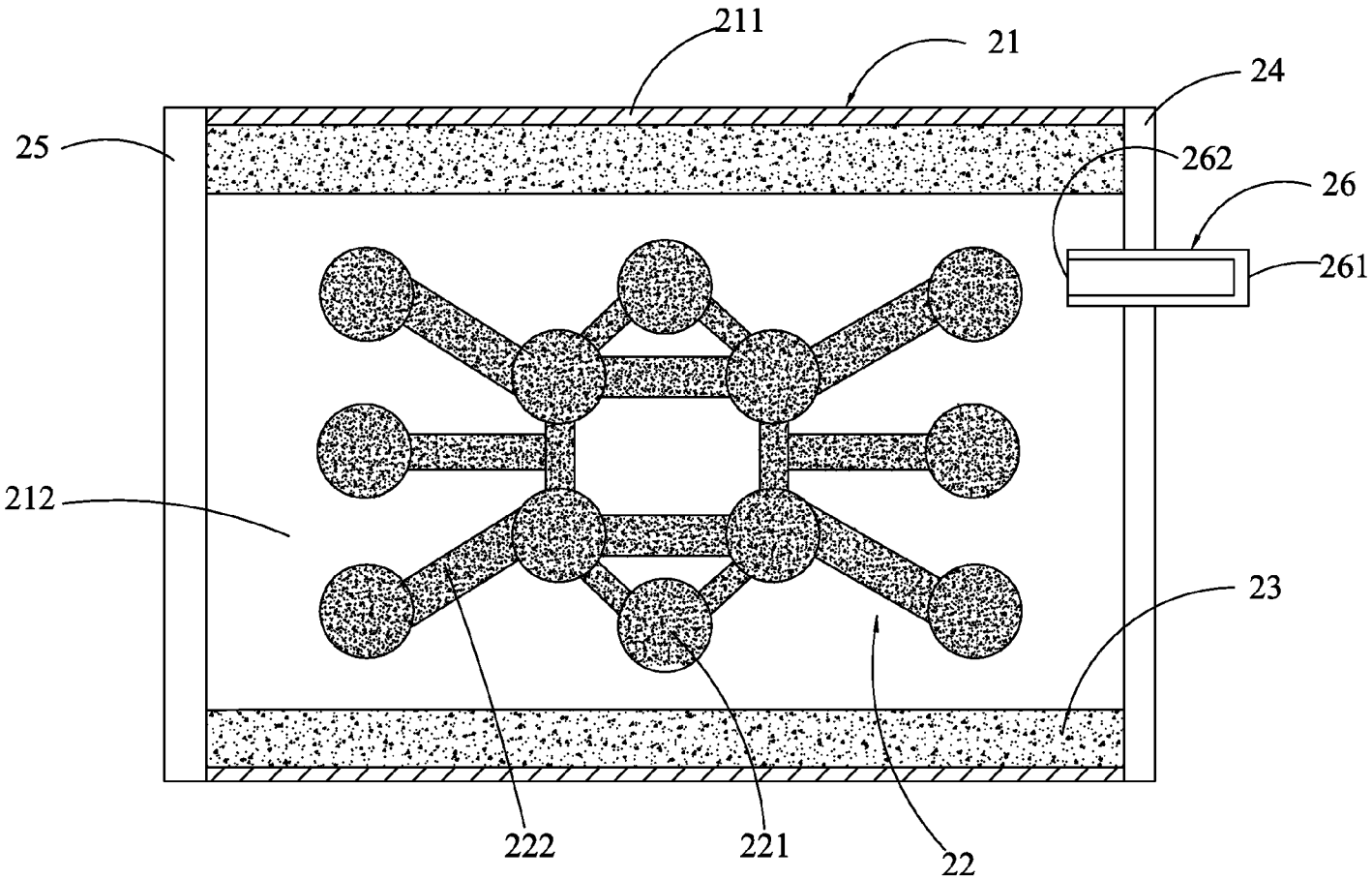
FIG. 2 is a top perspective view of the present invention.

As shown in FIG. 2, the pipe 21 is flattened and has a continuously surrounding wall unit 211. The wall unit 211 defines a chamber 212 therein. Both sides of the wall unit 211 are formed with a first sealing side 24 and a second sealing side 25 respectively, whereby the chamber 212 can be sealed to form a sealed space.

Figure 3A:
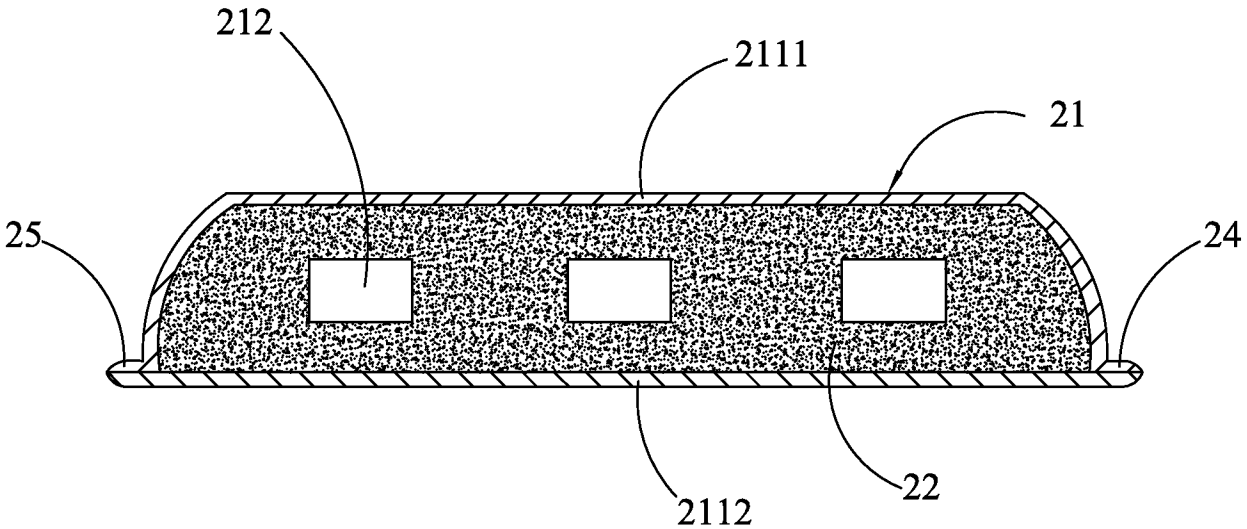
FIG. 3A is a first cross-sectional view of the present invention.
Figure 3B:
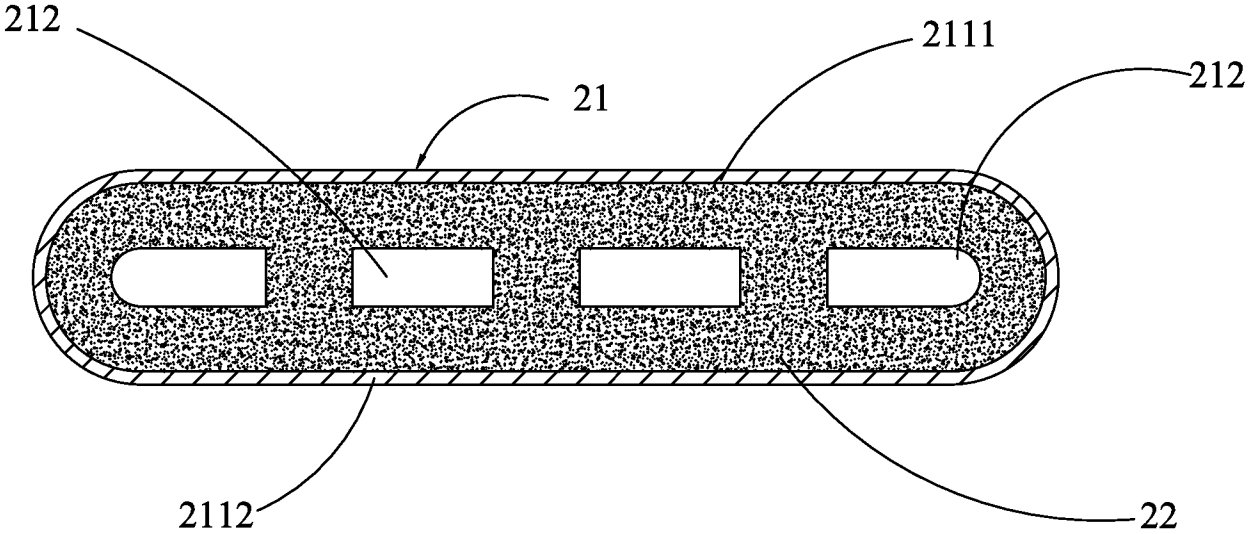
FIG. 3B is a second cross-sectional view of the present invention.
Figure 4:
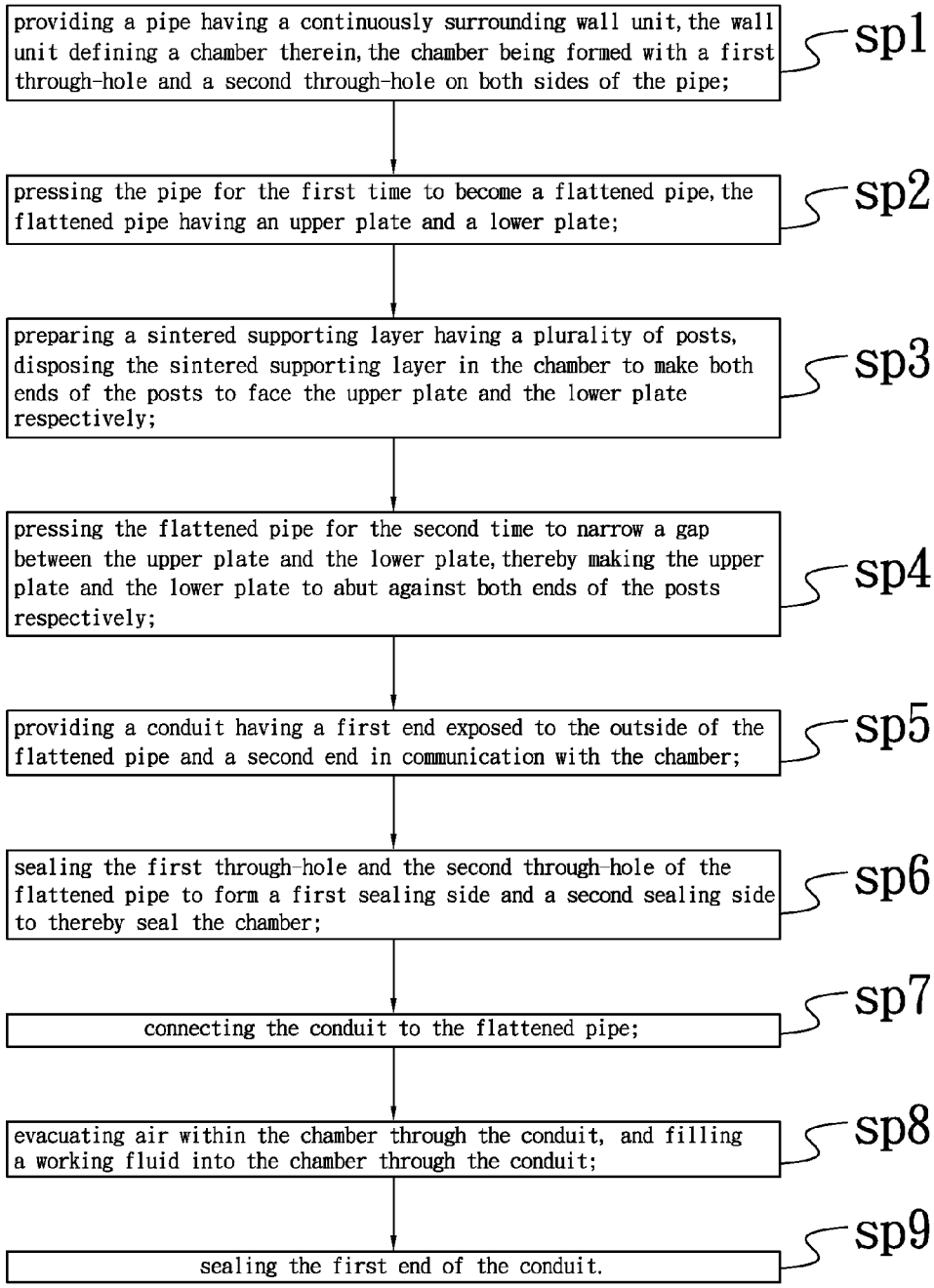
FIG. 4 is a flow chart of a manufacturing method of the present invention.

Please refer to FIGS. 3A and 3B. The wall unit 211 has an upper plate 2111 and a lower plate 2112 facing the upper plate 2111. The first sealing side 24 and the second sealing side 25 are respectively formed on both sides of the upper plate 2111 and the lower plate 2112. The first sealing side 24 is arranged adjacent to the upper plate 2111 and the lower plate 2112, and the second sealing side 25 is arranged adjacent to the upper plate 2111 and the lower plate 2112. In the present embodiment, the pipe 21 is preferably made by copper.

Please refer to FIG. 2 again. In the present embodiment, the sintered supporting layer 22 has a plurality of posts 221 and a plurality of connecting elements 222.

The posts 21 are arranged in the chamber 212 to vertically support between the upper plate 2111 and the lower plate 2112 (as shown in FIGS. 3A and 3B). Both ends of each post 221 are connected to the upper plate 2111 and the lower plate 2112 respectively. A portion of the connecting elements 222 are each connected to two posts 221. The other portion of the connecting elements 222 are each arranged in such a manner that one end thereof is connected to one post 221 and the other end is connected to another connecting element 222. The connecting elements 222 are configured to maintain the structural strength of the sintered supporting layer 12. Both sides of each connecting element 222 are connected to the upper plate 2111 and the lower plate 2112 respectively.

The sintered supporting layer 22 (including the posts 221 and the connecting elements 222) is formed of a wick structure made of sintered powders, fibers or foams. In the present embodiment, the wick structure layer 23 is, substantially the same as the sintered supporting layer 22, made by sintered powders, fibers or foams and coated on one surface of the wall unit 211 facing the chamber 212.

Then, a conduit 26 is connected to the first sealing side 24 or the second sealing side 25. In the present embodiment, the conduit 26 is connected to the first sealing side 24. The conduit 26 has a first end 261 exposed to the outside of the pipe 21 as an sealed end, and a second end 262 in communication with the chamber as an open end. A working fluid can be filled in the chamber 212 through the conduit 26. Alternatively, the air within the chamber 212 can be evacuated through the conduit 26, and then the first end 261 is sealed immediately. In this way, a sealed vacuum space can be formed in the chamber 212.

Please refer to FIGS. 3A and 3B again. The lower plate 2112 is brought into contact with a heat-generating element (such as a central processor). At this time, the lower plate 2112 is referred to as an evaporating end for conducting the heat generated by the heat-generating element to the upper plate 2111 (referred to as a condensing end). The heat generated by the heat-generating element is absorbed by the lower plate 2112, thereby heating and evaporating the working fluid flowing in the wick structure layer 23 and the sintered supporting layer 22.

The thus-formed vapors quickly flow to a colder portion (i.e. the upper plate 2111) and the vapors release their latent heat when being brought into contact with the upper plate 2111. Then, the vapors condense into liquid. The thus-condensed droplets of the working fluid flows back to the lower plate 2112 by means of the capillary force in the wick structure layer 23 and the sintered supporting layer 22. In this way, the working fluid can be circulated in the sealed chamber 212.

Further, please refer to FIGS. 4 to 8, which show the method for manufacturing the flat plate heat pipe of the present invention. The method of the present invention includes steps as follows.

Figure 5:
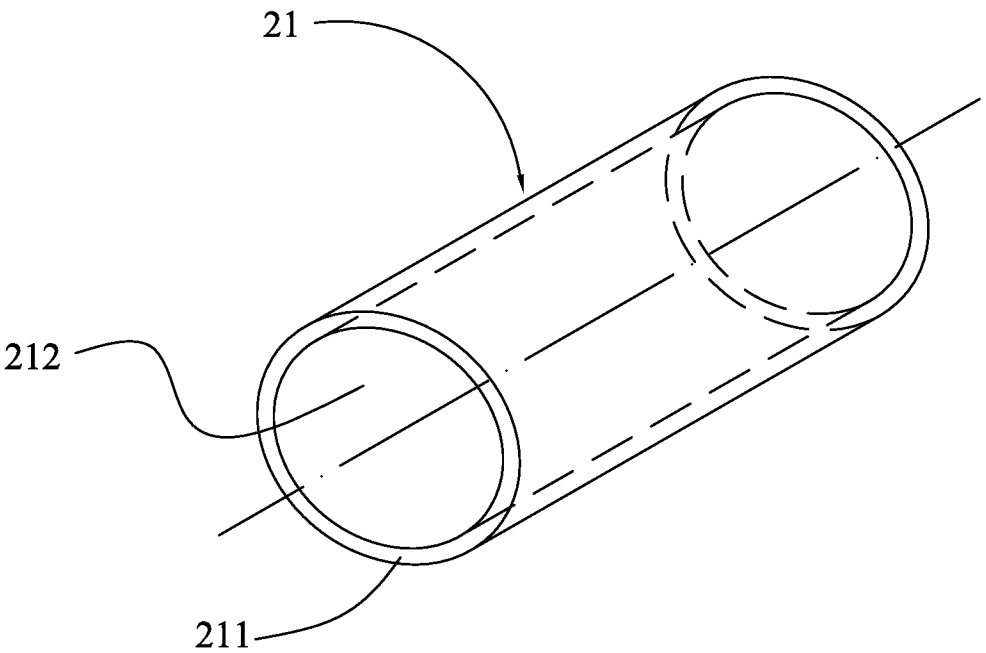
FIG. 5 is a schematic view showing a pipe not pressed.

In the first step (sp1), a pipe 22 is provided. The pipe 21 is formed into a hollow cylinder but the shape of the pipe 21 in the present invention is not limited thereto. The pipe 21 has a continuously surrounding wall unit 211 defining a chamber 212 therein. The chamber 212 is formed with a through-hole on both sides of the pipe 21 (as shown in FIG. 5).

Figure 6:
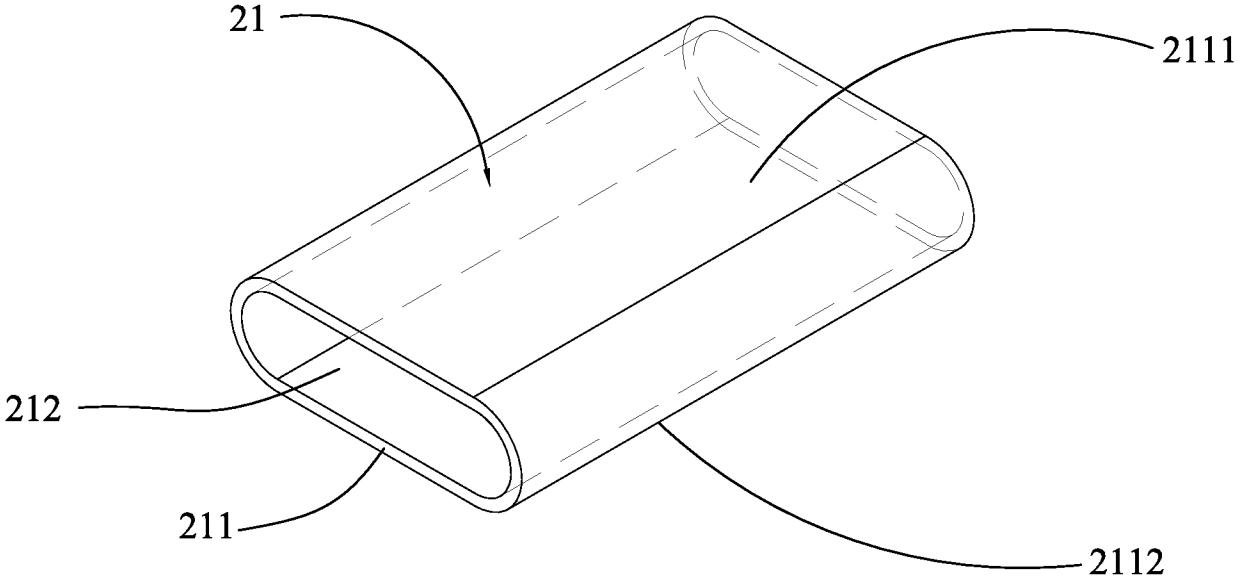
FIG. 6 is a schematic view showing the pipe being pressed for the first time.

In the second step (sp2), the pipe 21 is pressed for the first time (preliminary pressing), whereby by the pipe 21 is made flattened with an upper plate 2111 and a lower plate 2112 being formed on the wall unit 211. The upper plate 2111 faces the lower plate 2112. By controlling the force used for pressing the pipe 21, a suitable gap can be made between the upper plate 2111 and the lower plate 2112 for accommodating the sintered supporting layer 22 (as shown in FIG. 6).

Figure 7:
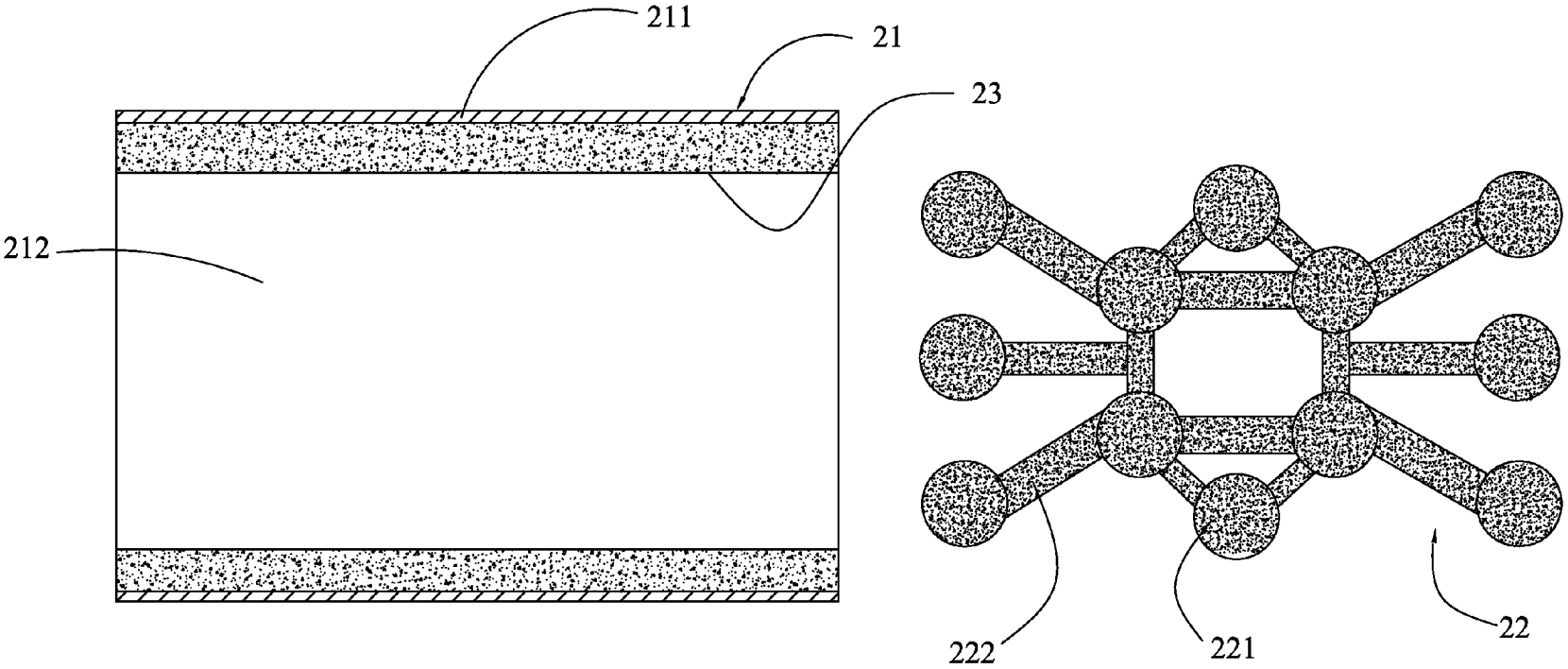
FIG. 7 is a schematic view showing a sintered supporting layer not disposed in the chamber.

In the third step (sp3), the sintered supporting layer 22 is prepared to have a plurality of posts 221 and connecting elements 222. Then, the sintered supporting layer 22 is disposed in the chamber 212 in such a manner that both ends of the posts 221 face the upper plate 2111 and the lower plate 2112 respectively, and both sides of the connecting elements 222 face the upper plate 2111 and the lower plate 2112 (as shown in FIGS. 6 and 7). In the present step, the sintered supporting layer 22 is made by a conventional process. More specifically, a mould is prepared, in which a plurality of cavities is randomly arranged in communication with each other. Powders (such as copper powders) are tightly filled in these cavities and then sintered to form a wick structure. Alternatively, fibers or foams may be filled in the mould to form the wick structure.

In the fourth step (sp4), the flattened pipe 21 is pressed for the second time, so that the gap between the upper plate 2111 and the lower plate 2112 can be reduced further. As a result, the upper plate 2111 and the lower plate 2112 can abut against both ends of the posts 221 and both sides of the connecting elements 222. In this step, the upper plate 2111 and the lower plate 2112 are strongly pressed to abut against both ends of the post 221 of the sintered supporting layer 22 and both sides of the connecting elements 222. At the same time, the posts 221 and the connecting elements 222 are vertically supported between the upper plate 2111 and the lower plate 2112 (as shown in FIGS. 3A and 3B).

Figure 8:
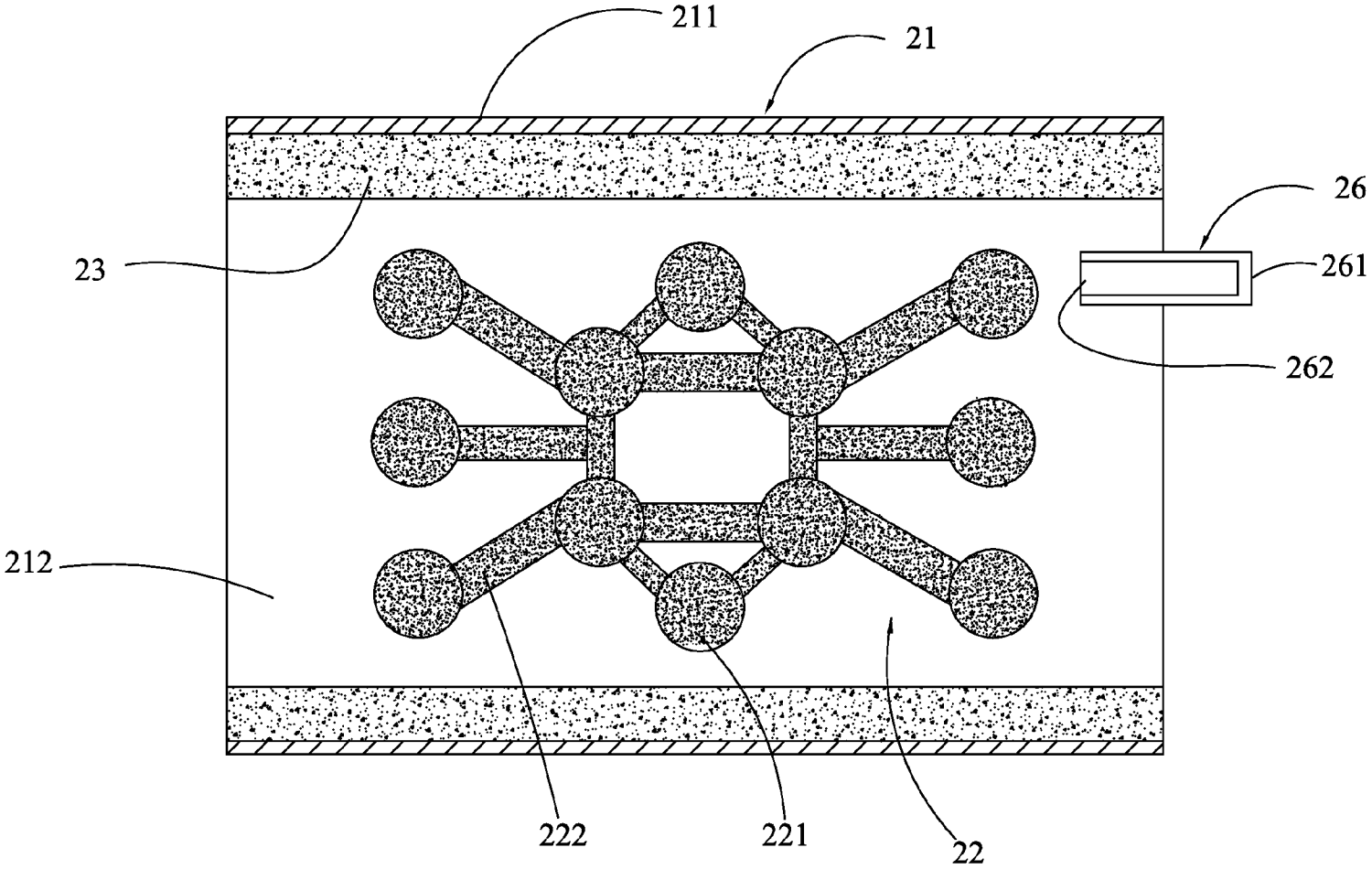
FIG. 8 is a schematic view showing a conduit being disposed in the pipe.

In the fifth step (sp5), a conduit 26 is disposed in any one of the through-holes in such a manner that the first end 261 of the conduit 26 is exposed to the outside of the flattened pipe 21 and its second end 262 is in communication with the chamber 212 (as shown in FIG. 8).

In the sixth step (sp6), the two through-holes of the flattened pipe 21 are sealed to form the first sealing side 24 and the second sealing side 25 to thereby seal the chamber 212. Both ends of the posts 221 are connected to the upper plate 2111 and the lower plate 2112 respectively. Both sides of the connecting elements 222 are connected to the upper plate 2111 and the lower plate 2112 respectively. In this step, the above-mentioned connections are achieved by diffusion binding excluding the conduit 26 in the first sealing side 24 (as shown in FIG. 2).

In the seventh step (sp7), the conduit 26 is connected with the flattened pipe 21 by a soldering process, thereby sealing the connecting portion between the conduit 26 on the first sealing side 24 and the flattened pipe 21. Not only the conduit 26 is fixed, but also the seam between the conduit 26 and the flattened pipe 21 is sealed.

In the eighth step (sp8), the air inside the chamber 212 is evacuated through the conduit 26. Then, the working fluid is filled in the chamber 212 via the conduit 26. In this step, the chamber 212 is firstly made vacuum, and then the working fluid is filled in the chamber, so that the working fluid can be operated in a real vacuum.

In the ninth step (sp9), the first end 261 of the conduit 26 is sealed to thereby completely seal the chamber 212 (as shown in FIG. 2).

Before the step sp1, the wick structure layer 23 is formed on one surface of the wall unit 211 facing the chamber 212 in the pipe 21. Alternatively, the wick structure layer 23 can be prepared in advance, and then the wick structure layer 23 is connected to one surface of the wall unit 211 facing the chamber 212.

In comparison with prior art, the present invention has advantages features as follows.

(1) A sintered supporting layer is configured to support between the upper plate and the lower plate of the flattened pipe, thereby preventing the deformation of the flattened pipe and maintaining a sufficient structural strength. Since a number of apertures are formed in the sintered supporting layer, the vapor-phase working fluid can fill up the whole space within the flat plate heat pipe. Further, the condensed droplets of the working fluid can flow in the sintered supporting layer in transverse and longitudinal directions thereof, thereby increasing the return path of the working fluid.

(2) The pipe is pressed to form a flattened pipe rather than connecting an upper casing and a lower casing together performed in prior art. Thus, the wall thickness of the flattened pipe can be made thinner, so that the heat pipe can be made more compact. On the other hand, only two sides of the heat pipe are sealed to form a sealed chamber rather than sealing four sides of the upper casing and the lower casing performed in prior art. Thus, a larger space inside the chamber can be obtained for the operation of the working fluid.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A flat plate heat pipe, comprising:

a flattened hollow pipe section, formed by pressing a hollow pipe, the flattened pipe section providing a continuous surrounding wall unit, a first open end and a second open end, a chamber defined in the continuously surrounding wall for receiving a working fluid, the continuous surrounding wall unit having an upper plate, a lower plate facing the upper plate and two side plates continuously surrounding the chamber, wherein the first open end and the second open end are sealed and formed into a first sealing end and a second sealing end by diffusion bonding, wherein the chamber is sealed between the first sealing end and the second sealing end;

a sintered middle layer disposed in the chamber, the sintered middle layer having a plurality of posts to stand between the upper plate and the lower plate of the flattened hollow pipe section, a plurality of separate horizontal extending elements, each of the plurality of posts having at least one horizontal extending element formed on a circumference of the post, the horizontal extending element extending horizontally and connecting with another post, wherein the plurality of posts and the plurality of separate horizontal extending elements are organized in a polygonal formation with a plurality of posts located separately at two opposite sides of the polygonal formation each separate post being connected to the polygonal formation by one horizontal extending element; and a wick structure layer coated on an internal surface of the upper plate and the lower plate of the wall unit facing the chamber, wherein the working fluid in the chamber flows through the wick structure layer; and wherein the posts have a top end and a bottom end being connected to the wick structure layer of the upper plate and the lower plate respectively and each horizontal extending element has a top side and a bottom side being connected to the wick structure layer of the upper plate and the lower plate respectively; and wherein the working fluid in the chamber flows through the sintered middle layer in both vertical and horizontal directions to increase the return path of the working fluid.

2. The flat plate heat pipe according to claim 1, wherein a conduit is connected to any one of the first sealing side and the second sealing side, the conduit has a first end exposed to the outside of the pipe and a second end in communication with the chamber, the first end is a sealed end.

3. The flat plate heat pipe according to claim 1, wherein the sintered middle layer is constituted of a wick structure.

4. The flat plate heat pipe according to claim 3, wherein the posts are formed into arbitrary shapes.

5. The flat plate heat pipe according to claim 3, wherein the wick structure is formed of any one of sintered powders, fibers or foams.

6. The flat plate heat pipe according to claim 1, wherein the pipe is made of copper.

7. The flat plate heat pipe according to claim 1, wherein the wick structure layer is formed of any one of sintered powders, fibers or foams.

* * * * *